US005989769A

United States Patent [19]

Mosher et al.

[11] Patent Number: 5,989,769

[45] Date of Patent: Nov. 23, 1999

[54] LIQUID DEVELOPERS AND PROCESSES THEREOF

[75] Inventors: Ralph A. Mosher, Rochester; William M. Prest, Jr.; Paul W. Morehouse, Jr., both of Webster; Samuel Kaplan, Walworth; Timothy J. Fuller, Pittsford; Weizhong Zhao, Webster; Anita C. VanLaeken, Macedon; Raymond W. Stover, Webster, all of N.Y.

[73] Assignee: Xerox Corporation, Stamford, Conn.

[21] Appl. No.: 09/182,786

[22] Filed: Oct. 30, 1998

[51] Int. Cl.[6] ..... G03G 9/135; G03G 13/10; G03G 15/10

[52] U.S. Cl. ..... 430/115; 430/119; 399/237

[58] Field of Search ..... 430/115, 119

[56] References Cited

U.S. PATENT DOCUMENTS

| | | | |
|---|---|---|---|
| 3,819,386 | 6/1974 | Higgins et al. | 106/32 |
| 4,104,183 | 8/1978 | Tsubuko et al. | 430/114 |
| 4,507,515 | 3/1985 | Johnston et al. | 585/12 |
| 4,659,640 | 4/1987 | Santilli | 430/114 |
| 5,230,834 | 7/1993 | Gutierrez et al. | 252/47.5 |
| 5,382,492 | 1/1995 | El-Sayed et al. | 430/115 |
| 5,563,015 | 10/1996 | Bonsignore et al. | 430/106 |
| 5,565,299 | 10/1996 | Gibson et al. | 430/137 |
| 5,567,564 | 10/1996 | Ziolo | 430/115 |
| 5,570,173 | 10/1996 | Nye et al. | 399/237 |
| 5,612,777 | 3/1997 | Malhotra | 399/226 |
| 5,643,984 | 7/1997 | Mueller et al. | 524/272 |
| 5,655,192 | 8/1997 | Denton et al. | 399/240 |
| 5,714,993 | 2/1998 | Koeshkerian et al. | 347/95 |
| 5,759,733 | 6/1998 | Tsubuko et al. | 430/115 |

*Primary Examiner*—Roland Martin
*Attorney, Agent, or Firm*—John L. Haack

[57] ABSTRACT

A liquid developer composition including: a resin, a colorant, a liquid carrier vehicle, and a cake inducing agent.

23 Claims, 2 Drawing Sheets

LIQUID DEVELOPERS AND PROCESSES THEREOF

REFERENCE TO COPENDING APPLICATIONS

Attention is directed to commonly owned and assigned Application Number, U.S. Ser. No. 08/963,360 filed Nov. 3, 1997, now abandoned, entitled "Method and Apparatus for Liquid Developing Material Based Latent Image Development".

The disclosure of the above mentioned copending application is incorporated herein by reference in its entirety. The appropriate components and processes of the disclosure may be selected for the inks and processes of the present invention in embodiments thereof.

BACKGROUND OF THE INVENTION

The present invention is generally directed to liquid toner and developer compositions and to imaging processes thereof. More specifically, the present invention relates to improved liquid developer compositions and improved development processes thereof arising from, for example, including a caking agent in the liquid developer.

A significant problem associated with prior art liquid developers is print defects in the resulting image quality which is believed to be attributable to the inability of initial, intermediate, or final developed solids image to form proper and substantive cake images or developer monoliths. The inability of the developer to form substantive or proper cake monoliths is believed to result from high shear and stress forces that act upon the image cake during development and subsequent removal of the liquid carrier vehicle.

These and other image formation and defect problems are solved in embodiments of the present invention.

PRIOR ART

In U.S. Pat. No. 5,230,834, issued Jul. 27, 1993, to Gutierrez et al., there is disclosed a composition useful as a multifunctional viscosity improver-dispersant for oleaginous compositions, particularly lubricating oil compositions, comprising at least one adduct or reaction product of (A) ethylene copolymer, preferably ethylene propylene copolymer of at least 15,000 number average molecular weight grafted with monounsaturated mono- or dicarboxylic acid material; (B) amido-amine or thioamido-amine comprising reaction product of at least one amine, preferably polyamine, and an alpha, beta-unsaturated compound represented by the formula R1R2C═CR3—CXY wherein X is sulfur or oxygen, Y is —OR4, —SR4, or —NR4R5 and R1, R2, R3, R4 and R5 are independently selected from hydrogen, hydrocarbyl, and substituted hydrocarbyl, and (D) viscosity stabilizing effective amount of C12 to about C18 hydrocarbyl substituted dicarboxylic anhydride. The invention is also directed to oleaginous compositions and concentrates, particularly lubricating oil compositions and concentrates, containing said adduct whereby said compositions exhibit improved viscosity stability for extended periods of time.

In U.S. Pat. No. 3,819,386, issued Jun. 25, 1974, to Higgins et al., there is disclosed rheology modifiers for inks and a dispersion comprising a non-polar organic liquid, an alkaline earth metal salt of a fatty acid or substituted fatty acid, and a dispersant which is effective as a rheology modifier for imparting plastic flow to printing inks. The dispersant is characterized by the presence therein of at least one acyl, acyloxy or acylimidoyl group, typically derived from a carboxylic acid having at least about 50 carbon atoms, and at least one radical containing a nitrogen or oxygen atom connecting said acid-derived group to a hydrocarbon or substituted hydrocarbon radical.

In U.S. Pat. No. 4,507,515, issued Mar. 26, 1985, to Johnston et al., there is disclosed ethylene-alpha-olefin copolymers being particularly useful as improving the low temperature viscosity and pumpability properties of lubricating oil comprised of a major and minor component each of which have a defined ethylene sequence distribution with respect to the number of ethylenes in sequences of three or more and the percent of ethylene sequences of three or more ethylene units. Ethylene-propylene copolymers are the preferred embodiment.

In U.S. Pat. No. 5,643,984, issued Jul. 1, 1997, to Mueller et al., there is disclosed a wax composition for use in the ink industry, which composition is prepared from: (a) 40% to 90% of solvent having a boiling point within the range of about 100° to 550° C., said solvent being selected from the group consisting of aromatic and aliphatic solvents, (b) 10% to 40% of wax having an average particle size within the range of about 1 to about 300 microns, (c) 5% to 40% of polymeric pour point depressant, and optionally dependant on the characteristics required, 4% to 40% of a resin material which is soluble in aromatic and aliphatic solvents.

In U.S. Pat. No. 5,655,192, issued Aug. 5, 1997, to Denton et al., there is disclosed a method and apparatus for compaction of a liquid ink developed image in a liquid ink type multicolor electrostatographic printing machine of the type utilizing liquid developing material, particularly an image-on-image type liquid ink multicolor system. The image compacting apparatus includes a biased electrode situated proximate to the image on an image bearing surface, and a liquid applicator for depositing liquid insulating material in a conditioning gap defined by the electrode and the image bearing surface. A high electric potential is applied to the electrode for generating a large electric field in the gap to electrostatically compress toner particles into image areas on the image bearing surface. The liquid insulating material is deposited into the conditioning gap for avoiding the risk of air breakdown as may occur in an electrostatic device of this nature due to the small geometry of the apparatus and the tendency of air ionization in an air gap between electrically biased surfaces. Preferably, the liquid insulating material is the very same material utilized as the liquid carrier component of the liquid developing material.

Liquid developer and related compositions and processes for their preparation are known, reference for example, U.S. Pat. Nos. 5,563,015, 5,565,299, 5,567,564, 5,382,492, 5,714,993, 5,570,173, and 5,612,777. The disclosures of the aforementioned patents are incorporated herein by reference in their entirety.

There remains a need for liquid electrostatic toner and developer compositions and processes thereof which provide high quality and high resolution developed images over the entire range of known development and printing speeds.

The developers and development processes thereof of the present invention are useful in many applications, including toners for use in electrophotographic imaging processes, such as digital printing and copying systems including color systems, and for use for example, in liquid marking, such as liquid electrostatic printing, ink jet printing applications, and offset printing inks and applications.

SUMMARY OF THE INVENTION

Embodiments of the present invention, include:

A liquid developer composition comprising: a resin, a colorant, a liquid carrier vehicle, and a cake inducing agent; and A printing machine embodying an imaging process comprising: developing in a liquid developer housing a liquid developer composition comprising: a resin or resins, a colorant, a liquid carrier vehicle, and a cake inducing agent; and removing the carrier liquid, wherein there results enhanced cake formation and a developed image therefrom, and wherein the developed image is substantially free of ribbing and stipple defects.

These and other embodiments of the present invention are illustrated herein.

DETAILED DESCRIPTION OF THE INVENTION

Figure 1:
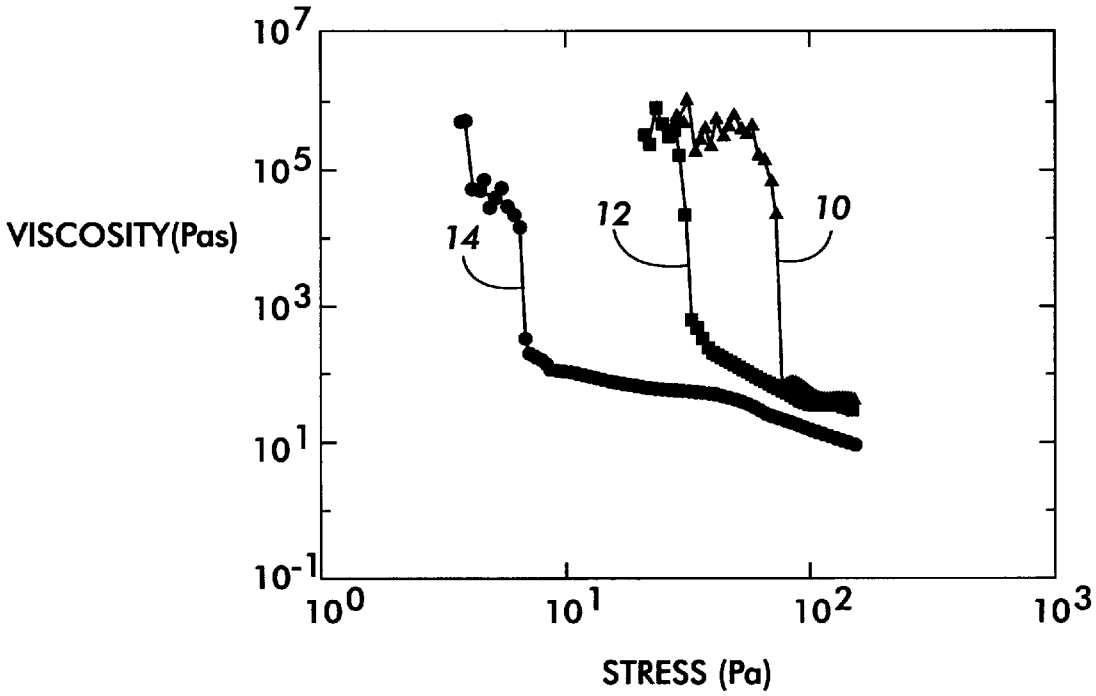
FIG. 1 illustrates the effect of a caking additive on rheological properties of developed liquid ink cakes or images of the present invention for a developer comprised of a single resin.

The developers and development processes of the present invention provide a simple and effective solution to the problem of poor or improper cake formation encountered, for example, in contact electrostatic printing systems which employ conventional liquid electrostatic toner or ink developer formulations. The inability of the liquid developers to form substantive cakes upon removal of the liquid carrier phase from the developed solids is believed to be caused by improper material feed and transfer of the incipient image cake through cake formation coater and/or rollers and consequently results in developed image defects known, for example, as ribbing and stipple on the coater and/or roller train and final printed image.

The addition of cake inducing agents, such as viscosity and elastic modifiers, to liquid xerographic inks improves and aids in feeding and spreading of the liquid ink by a roller train to form enhanced contact electrostatic printing (CEP) cakes. The cake inducing agents can also improve cake uniformity, reduce cake defects, such as ribbing and stipple on images without encumbering the contact electrostatic printing process.

"Ribbing" and "stipple" are terms of art in liquid xerographic electrostatic printing and processes thereof and describe image or print defects arising from uneven transfer of electrostatic images. Stipple is a generalized nonuniformity in coating which appears as small-scale flecks of light and dark distributed throughout the coated area. Ribbing is a coating defect which manifests itself as regular, periodic bands of excess coating alternating with regular periodic bands of insufficient coating. These alternating bands cover the coated surface and create a pattern of stripes. The stripes run in a direction parallel to the direction of motion of the coated surface during the coating process. In a liquid developer context, ribbing is the formation of strings of liquid developer cake from the developed image-bearing member, such as a photoreceptor, to either the intermediate or receiving substrate such as paper. Stipple is the uneven incomplete transfer of the liquid toner image to the intermediate or receiving substrate.

In the aforementioned copending application U.S. Ser. No. 08/963,360, now abandoned, the disclosure of which is incorporated by reference herein in its entirety, there is disclosed:

A contact electrostatic printing or imaging apparatus, comprising:

a first movable member for having an electrostatic latent image formed thereon including image areas defined by a first voltage potential and non-image areas defined by a second voltage potential;

a second movable member for having a layer of liquid developing material coated thereon; and a process nip formed by operative engagement of the first movable member and the second movable member for positioning the layer of liquid developing material in pressure contact with the first movable member, wherein the electrostatic latent image on the first member generates imagewise electric fields across the layer of liquid developing material in the process nip;

the process nip being defined by a nip entrance and a nip exit, wherein the nip and the nip entrance are operative to apply compressive stress forces on the layer of liquid developing material thereat, and the nip exit is operative to apply tensile stress forces to the layer of liquid developing material for causing imagewise separation of the layer of liquid developing material thereat, for creating a developed image corresponding to the electrostatic latent image; and the layer of liquid developing material being defined by a yield stress threshold in a range sufficient to allow the layer of liquid developing material to behave substantially as a solid at the nip entrance and in the nip, while allowing the layer of liquid developing material to behave substantially as a liquid along the image/background interfaces at the nip exit; and An electrostatographic imaging process, comprising:

providing a first movable member for having an electrostatic latent image formed thereon including image areas defined by a first voltage potential and non-image areas defined by a second voltage potential;

providing a second movable member for having a layer of liquid developing material coated thereon; and forming a process nip by operative engagement of the first movable member and the second movable member, the process nip being defined by a nip entrance and a nip exit;

positioning the layer of liquid developing material in pressure contact with the first movable member in the process nip, wherein the electrostatic latent image on the first member generates imagewise electric fields across the layer of liquid developing material in the process nip;

applying compressive stress forces on the layer of liquid developing material at the nip and the nip entrance;

applying tensile stress forces to the layer of liquid developing material at the nip exit for causing imagewise separation of the layer of liquid developing material thereat; and providing the layer of liquid developing material so as to have a yield stress threshold in a range sufficient to allow the layer of liquid developing material to behave substantially as a solid at the nip entrance and in the nip, while allowing the layer of liquid developing material to behave substantially as a liquid along the image/background interfaces at the nip exit.

The disclosure of the aforementioned copending application is incorporated herein by reference in its entirety.

The present invention provides liquid developer compositions comprising: a resin, a colorant, a liquid carrier vehicle, and a cake inducing agent. The developer compositions substantially eliminate the aforementioned ribbing and stipple image defects in liquid developer printing processes as illustrated herein.

The cake inducing agent can be polymers or copolymers such as polyolefins and hydrogenated analogs thereof, for example, polyethylene, polypropylene, poly(1-hexene), poly(1-heptene), poly(1-octene); copolymers and terpolymers formed from two or more olefinic monomers and hydrogenated analogs thereof, for example, random and block ethylene-propylene copolymers, poly(propylene-co-1-butene), poly(propylene-co-1-butene-co-ethylene), poly (propylene-alt-ethylene)-multiarm, poly(isobutylene-co-isoprene), poly(ethylene-butadiene), poly(ethylene-co-1-butene-co-1-hexene); olefin-vinylacetate copolymers and hydrogenated analogs thereof; olefin-acrylate copolymers and hydrogenated analogs thereof, for example; olefin-acrylic acid copolymers; olefin-acrylic acid ester copolymers; olefin-methacrylic acid ester copolymers; and the like polymers and copolymers, and mixtures thereof. Hydrogenated analogs includes from partially to completely hydrogenated or saturated products.

A preferred cake inducing agent is a copolymer of the formula $[A\text{-}B\text{-}X]_n$ wherein A represents an ethylene group, B represents a propylene group, and X represents a pendant hydrogen or an amine group, and n is an integer from about $1\times10^3$ to about $1\times10^5$, and wherein A, B, and X groups are distributed substantially randomly along the polymer chain. A particularly preferred cake inducing agent is a random ethylene-propylene copolymer with an ethylene content of from about 40 to about 60 weight percent, a propylene content of about 40 to about 60 weight percent, and optionally an amine graft content of about 1 to about 5 weight percent, and wherein the copolymer has a weight average molecular weight of about $2\times10^5$, a number average molecular weight of about $1\times10^5$, and a polydispersity of about 2.

The caking agent produces a highly uniform image cake with a high solids content of from about 5 to about 50 weight percent. Further, the caking agent, in embodiments, can produces image cakes with low liquid carrier vehicle content and which image cakes require little or no additional liquid removal or conditioning.

The cake inducing agent can be present in the developer in amounts of from about 0.1 to about 20 weight percent of the solids content of the developer. The cake inducing agent can have a weight average molecular weight ($M_w$) of from preferably about 50,000 to about 500,000, and a number average molecular weight ($M_n$) of from about 20,000 to about 250,000, and a polydispersity (ratio of $M_w$ to $M_n$) of from about 1.0 to about 5.0, and preferably from about 1.0 to about 3.0, and more preferably from about 1.0 to about 2.0, although values outside these ranges are also useful.

Although not wanting to be limited by theory, it is believed that the caking agent additive functions to reduce the yield stress and increases the elasticity of the ink formulation thereby promoting the formation of a superior liquid ink cake.

The marking resin or resins of the developer comprise polymers or copolymers, for example, of acrylates, styrenes, polyesters, olefins such as poly(ethylene-propylene) copolymers, and the like, and mixtures thereof. In embodiments from 2 to about 10 resins can be selected for the resin component of the liquid developer.

The colorant can be one or more pigments, one or more dyes, and mixtures thereof. The colorant can be a pigment, for example, carbon black, magnetite, cyan, yellow, magenta, red, green, blue, brown, orange, and the like, and mixtures thereof.

In embodiments, the present invention provides a liquid toner composition comprising:

a resin, such as poly(ethylene-methacrylic acid) copolymer, in an amount of from about 55 to about 90 weight percent of the solids content;

at least one pigment, such as Hostaperm Pink, in an amount of from about 5 to about 45 weight percent of the solids content;

a cake inducing additive, such as a random ethylene-propylene copolymer, in an amount of about 0.1 to about 20 weight percent of the solids content, and optionally the additive contains between about 1 and about 5 mole percent grafted or pendant amino groups, of the formulas $—NR_2$, where R is independently hydrogen, alkyl with from 1 to 20 carbon atoms, and the like substituents;

a liquid carrier vehicle, such as hydrocarbons NORPAR® 15 or ISOPAR® L commercially available from Exxon Corp., in an amount of about 75 to about 99 weight percent of the total weight of the composition; and optionally a charge control agent, such as aluminum stearate or aluminum complex salts, or charge director, such as lecithin or quaternary ammonium substituted block copolymer prepared by group transfer polymerization, in an amount of about 0.5 to about 5.0 weight percent of the solids content, and wherein the solids content of the composition is from 1 to about 3 weight percent of the total weight of the composition.

In the aforementioned liquid developer composition, preferred and particularly preferred caking agents are as recited above. A preferred resin is an ethylene-methacrylic acid copolymer. A preferred pigment is carbon black. A preferred liquid carrier is a hydrocarbon, for example, an ISOPAR®.

In embodiments, the present invention provides a process comprising: developing images with a liquid developer containing a cake inducing compound of the formula $[A\text{-}B\text{-}X]_n$ in an amount of from about 0.1 to about 20 weight percent based on solids content of the liquid developer where A represents an ethylene polymeric segment, B represents a propylene polymeric segment, and X represent a pendant hydrogen or an amine group which amine may be chemically attached to either or both A and B mers or segments in the polymer chain, and n is an integer from $1\times10^3$ to about $1\times10^5$, although values can be outside this range, and wherein there is obtained improved image development and formation and a reduction in image defects. The caking agent can be dispersed in the resin particles, dispersed in the liquid carrier vehicle, or dispersed in both resin and liquid phases.

In embodiments, the present invention provides an imaging process comprising:

developing in a liquid developer housing a liquid developer composition comprising: a resin or resins, a colorant, a liquid carrier vehicle, and a cake inducing agent; and removing the carrier liquid, wherein there results enhanced developed image cake formation, and wherein the developed image is free of ribbing and stipple defects.

The present invention provides a printing machine for printing images from liquid developers disclosed herein. The liquid developer housing can be adapted for a variety of printing processes and machines, for example, contact electrostatic printing in an electrostatic liquid developer printing machine device or apparatus.

In embodiments the present invention provides a printing machine comprising a the liquid developer housing, a liquid developer receiver member, an intermediate transfer member, a liquid carrier removal member, and a liquid developer composition comprising: a resin or resins, a colorant, a liquid carrier vehicle, and a cake inducing agent as described and illustrated herein.

Liquid developer and related compositions and processes for their preparation are known, reference for example, U.S. Pat. Nos. 5,563,015, 5,565,299, 5,567,564, 5,382,492, 5,714,993, 5,570,173, and 5,612,777, the disclosures of which are incorporated herein by reference in their entirety.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of a Magenta Liquid Developer with Cake Inducing Agent

A resin such as polyethylene-methacrylic acid commercially available as NUCREL RX76, 25 grams, 15 weight percent Hostaperm Pink, 0.7 weight percent Witco 22, and ISOPAR® L (170 g) were added to a Union Process O1 shot mill attritor equipped with ⅜-inch stainless steel shot (2,500 g). The mixture was stirred at 50 rpms while the reactor contents were heated with steam to about 200° F. Steam heating was then discontinued and stirring at ambient temperature was continued for 2 hours while the temperature had reached 100° F. The reactor was then cooled by external jacketed cooling water while stirring was continued for 4 hours. The resulting ink was sieved to remove the steel shot and which shot was washed with ISOPAR® L and the combined washings were added to the filtrate. The resulting ink at 7 weight percent solids was centrifuged to form a toner concentrate at 15 weight percent solids. To this liquid toner concentrate was added a caking agent, such as ethylene-propylene copolymer optionally containing from about 1 to about 5 mole-percent grafted amino groups.

A particularly preferred caking agent is commercially available from Exxon Chemical Company as VISTALON Ethylene Propylene Rubber V457 an olefin polymer designated as an ethylene propylene copolymer/terpolymers/oil extended polymer.

Alternatively, a caking agent could be isolated from a commercially available motor oil performance enhancing additive known as STP™ by precipitation as follows: motor oil additive (25 mL) was added to a Waring blender containing methanol (0.75 liter). The solid residue that precipitated and stuck to the sides of the blender jar was washed with hexanes and then methanol, and then the solid was vacuum dried to yield a translucent white polymer believed to be an amino grafted ethylene-propylene copolymer. The caking agent polymer was identified by proton and carbon-13 nuclear magnetic resonance spectrometry as a copolymer of ethylene and propylene. A material safety datasheet describes the isolated ingredient as an "amine grafted ethylene/propylene copolymer." This additive, although not desired to be limited by theory, is believed to contain, for example, from about 1 to about 5 mole percent of grafted or pendant amino (—$NH_2$) groups. Gel permeation chromatography indicated a weight and number average molecular weight of about $2\times10^5$ and about $1.5\times10^5$, respectively.

Preparation of a Yellow Liquid Ink with Mixed Resins and Cake Inducing Agent

The toner resins were a 1:1 weight ratio blend of ELVAX® 200W commercially available from Du Pont and NUCREL® RX-76 a copolymer of ethylene and methacrylic acid, and included 0.7 weight percent Alohas(aluminum stearate) additive. The resin particles were prepared by hot mixing in an attritor for two hours a mixture of the NUCREL® RX-76 resin and powdered Alohas. Then ELVAX® 200W and Rhodamine Y pigment was added to the attritor and hot mixed with the RX-76 and powdered Alohas. A cold step was accomplished with four hours cold grind. The resulting toner was centrifuged to a solids content of 33 weight percent. Then various amounts of a 10 weight percent solution of caking agent comprised of ethylene propylene copolymer dissolved in ISOPAR® M were added to the 33 weight percent toner to dilute the solids content to about 26 percent by weight for evaluation. A series of toners with 26 weight percent solids and containing the ethylene propylene copolymer caking agent ranging from about 5 to about 80 percent by weight of the toner were prepared from the aforementioned 33 weight percent starting toner material.

COMPARATIVE EXAMPLE I

Preparation and Development of Liquid Developer without Cake Inducing Agent

Example I was repeated with the exception that the aforementioned cake inducing agent was omitted from the formulation with the result that image cakes formed with this developer produced images that possessed considerable and unsatisfactory ribbing and stipple image defects.

EXAMPLE II

Liquid Development Process with Liquid Developer Containing Cake Inducing Agent

The liquid developer prepared in Example I was used in an liquid development process as disclosed in the aforementioned copending Application Number, U.S. Ser. No. 08/963,360, now abandoned, and as described above. The results are summarized below and in the Figures.

Referring to the Figures, FIG. 1 shows the results of steady state rheological measurements of the relation of viscosity against shear stress for a magenta ink containing different levels of an amine modified ethylene-propylene copolymer cake inducing agent: at 0 weight percent (curve 10), 0.5 weight percent (12) and 5 weight percent (14). The caking agent is commercially available and is commonly used as a viscosity modifier or improver, for example, in lubrication products such as motor oils. At 5 weight percent (14) of the caking additive there is observed a yield stress reduction on the order of about a decade compared to the control, curve 10. When as little as 0.5 weight percent (12) of the caking additive is used, there is also observed a demonstrative and significant decrease in the ink yield stress.

Figure 2:
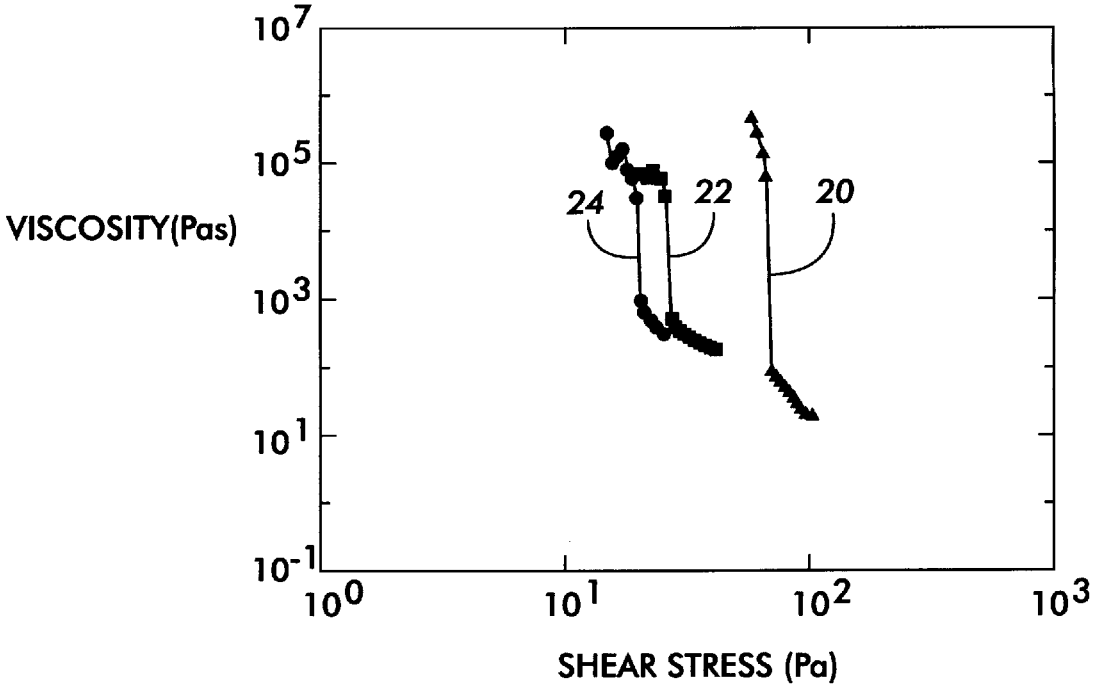
FIG. 2 illustrates the effect of a caking additive on rheological properties of developed liquid ink cakes or images of the present invention for a developer comprised of a blend of resins.

FIG. 2 shows a 1:1 mixed resin blend ink at 26 weight percent solids with caking additive present (curves 22 and 24), and without caking additive present (curve 20). An ethylene-propylene copolymer caking agent obtained from Exxon Corp. (curve 22), showed improvements comparable to that achieved with another caking additive, isolated from the aforementioned STP™ motor oil additive (curve 24). In a contact electrostatic printing test fixture using the above formulations containing caking agents there was observed improved quality of cake formation, for example, better spreading, better feeding of the cake through rollers, and lower levels of image defects, such as ribbing and stipple with these inks compared to control inks. The improvement in image quality was evident in side by side comparisons of developed test patches formed from developer with and without the caking agent present. The caking agent containing formulations showed uniform and excellent solid area development compared to poor image quality for formulations without caking agent present using either a electrostatic or offset press image development method.

Figure 3:
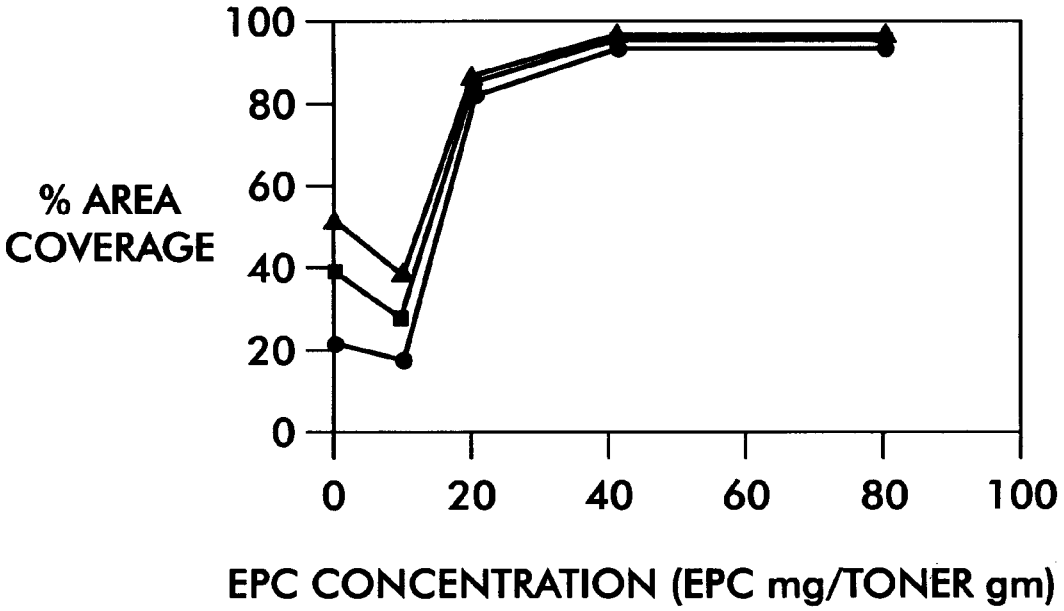
FIG. 3 illustrates the effect of concentration of a caking additive on percent area coverage of the resulting images.

FIG. 3 represents a measure of improved image development and uniformity with increasing concentration of ethylene-propylene copolymer (EPC) caking agent present in, for example the 1:1 blended mixed resin magenta ink used for the measurements of FIG. 2. Thus when the developer contained about 40 mg and above of caking agent additive per gram of developer solids, the percent area coverage appeared to be optimized or maximized with respect to maximum image quality for images formed on paper by contact electrostatic printing methods.

COMPARATIVE EXAMPLE II

Liquid Development Process with Liquid Developer without Cake Inducing Agent

The liquid developer prepared in Comparative Example I was used in an liquid development process in accordance with the liquid development process of Example II with the exception that the liquid developer was free of cake inducing agent. The development process produces considerable ribbing and stippling defects in the intermediate and final images.

Other modifications of the present invention may occur to one of ordinary skill in the art based upon a review of the present application and these modifications, including equivalents thereof, are intended to be included within the scope of the present invention.

What is claimed is:

1. A liquid developer composition comprising: a concentrate of a resin, a colorant, a liquid carrier vehicle, and a cake inducing agent, wherein the cake inducing agent is soluble in said carrier vehicle and wherein the solids content of the composition is from about 15 to about 33 weight percent of the total weight of the composition.

2. A liquid developer composition in accordance with claim 1, wherein the cake inducing agent is a polymer selected from the group consisting polyolefin homopolymers, polyolefin copolymers and terpolymers, amine containing polyolefins, olefin-vinyl acetate copolymers, olefin-acrylate copolymers, olefin-acrylic acid ester copolymers, olefin-methacrylic acid ester copolymers, hydrogenated analogs thereof, and mixtures thereof.

3. A liquid developer composition in accordance with claim 1, wherein the cake inducing agent is a copolymer of the formula $[A\text{-}B\text{-}X]_n$ wherein A represents an ethylene group, B represents a propylene group, and X represents a pendant hydrogen or an amine group, and n is an integer from about $1\times10^3$ to about $1\times10^5$, and wherein A, B, and X groups are distributed substantially randomly along the polymer chain.

4. A liquid developer composition in accordance with claim 1, wherein the cake inducing agent is a random ethylene-propylene copolymer with an ethylene content of from about 40 to about 60 weight percent, a propylene content of about 40 to about 60 weight percent, and optionally an amine graft content of about 1 to about 5 weight percent, and wherein the copolymer has a weight average molecular weight of about $2\times10^5$, a number average molecular weight of about $1\times10^5$, and a polydispersity of about 2.

5. A liquid developer composition in accordance with claim 1, wherein the cake inducing agent is present in an amount of from about 0.1 to about 20 weight percent of the solids content of the liquid developer.

6. A liquid developer composition in accordance with claim 1, wherein the cake inducing agent has a weight average molecular weight ($M_w$) of from about 50,000 to about 500,000, and a number average molecular weight ($M_n$) of from about 20,000 to about 250,000, and a polydispersity of from about 1.0 to about 3.0.

7. A liquid developer composition in accordance with claim 1, wherein from 2 to about 10 resins are selected.

8. A liquid developer composition in accordance with claim 1, wherein the colorant is selected from the group consisting of at least one pigment, at least one dye, and mixtures thereof.

9. A liquid developer composition in accordance with claim 1, wherein the colorant is a pigment selected from the group consisting of carbon black, magnetite, cyan, yellow, magenta, red, green, blue, brown, orange, and mixtures thereof.

10. A liquid developer composition in accordance with claim 1, wherein the colorant is carbon black.

11. A liquid developer composition in accordance with claim 1, wherein the resin comprises polymers or copolymers and mixtures thereof prepared from monomers selected from the group consisting of olefins, acrylates, styrenes, diesters, diacids, diamines, diols, and aminoalcohols.

12. A liquid developer composition in accordance with claim 1, further comprising a charge adjuvant, and a charge director.

13. A liquid toner composition comprising:

a resin in an amount of from about 55 to about 90 weight percent of the solids content;

at least one colorant in an amount of from about 5 to about 45 weight percent of the solids content;

a cake inducing additive in an amount of about 0.1 to about 20 weight percent of the solids content wherein the cake inducing agent is soluble in said carrier vehicle;

a liquid carrier vehicle in an amount of about 75 to about 99 weight percent of the total weight of the composition; and optionally a charge control agent, adjuvant, or charge director in an amount of about 0.5 to about 5.0 weight percent of the solids content, and wherein the solids content of the composition is from about 15 to about 33 weight percent of the total weight of the composition.

14. A liquid developer composition in accordance with claim 13, wherein the cake inducing additive is an ethylene-propylene copolymer with an ethylene content of from about 40 to about 60 weight percent, a propylene content of about 40 to about 60 weight percent, and optionally amine graft content of about 1 to about 5 weight percent, and the copolymer has a weight average molecular weight of about $1.0\times10^5$ to about $5.0\times10^5$, a number average molecular weight of about $4.0\times10^4$ to about $2.0\times10^5$.

15. A liquid developer composition in accordance with claim 13, wherein the resin is a poly(ethylene-methacrylic acid) copolymer.

16. A liquid developer composition in accordance with claim 13, wherein the colorant is a pigment.

17. A liquid developer composition in accordance with claim 13, wherein the liquid carrier is a hydrocarbon.

18. An imaging process comprising:

developing an image with a liquid developer composition according to claim 1, with a liquid developer housing on an intermediate receiver and thereafter transferring to an developer receiver; and removing the carrier liquid, wherein there results enhanced cake formation and enhanced image development, and wherein the intermediate and developed images are free of ribbing and stipple defects.

19. A process in accordance with claim 18, wherein the caking agent produces a highly uniform image cake with a high solids content of from about 5 to about 50 weight percent.

20. A process in accordance with claim 18, wherein the caking agent produces image cakes with low liquid carrier vehicle content of from about 50 to about 95 weight percent and which cakes require no further liquid removal.

21. An imaging process in accordance with claim 18, wherein the liquid developer housing is adapted for contact electrostatic printing in a liquid developer printing machine.

22. A process comprising developing images with a liquid developer composition according to claim 1 wherein the cake inducing agent is of the formula $[A\text{-}B\text{-}X]_n$ in an amount of from about 0.1 to about 20 weight percent based on the solids content of the developer where A represents an ethylene polymeric segment, B represents a propylene polymeric segment, and X represent a pendant hydrogen or an amine group, and n is an integer from $1\times10^3$ to about $1\times10^5$, and a polydispersity of from about 1.0 to about 3.0, and wherein there is obtained improved image development and formation, increased solids content of the developed image of from about 20 to about 50 weight percent, and a reduction in or elimination of image defects compared to developers without said caking inducing agent.

23. A printing machine comprising a liquid developer housing, a liquid developer receiver member, an intermediate transfer member, a liquid carrier removal member, and a liquid developer composition according to claim 1.

* * * * *